United States Patent [19]

Carr et al.

[11] Patent Number: 4,457,826

[45] Date of Patent: Jul. 3, 1984

[54] PREVENTION OF DELETERIOUS DEPOSITS IN A COAL LIQUEFACTION SYSTEM

[75] Inventors: Norman L. Carr, Allison Park; Michael E. Prudich, Pittsburgh; William E. King, Jr., Gibsonia; William G. Moon, Cheswick, all of Pa.

[73] Assignee: The Pittsburg & Midway Coal Mining Co., Englewood, Colo.

[21] Appl. No.: 341,547

[22] Filed: Jan. 26, 1982

[51] Int. Cl.[3] ..... C10G 1/00; C10G 1/06

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| Re. 25,770 | 4/1965 | Johnson | 208/10 |
| 3,503,865 | 3/1970 | Stone | 208/10 |
| 3,779,722 | 12/1973 | Tatum | 208/8 LE X |
| 3,840,456 | 10/1974 | Yavorsky et al. | 208/8 LE X |
| 4,108,759 | 8/1978 | Young | 208/10 |
| 4,120,664 | 10/1978 | Gleim | 208/8 LE X |
| 4,121,995 | 10/1978 | Hsu | 208/8 LE |
| 4,123,348 | 10/1978 | Wurfel | 208/10 |
| 4,151,073 | 4/1979 | Comolli | 208/8 R |

OTHER PUBLICATIONS

Power Requirements of Gas-Liq Agitated Systems, Michel et al., A.I.Ch.E. Journal, pp. 262–266, vol. 8, No. 2, May 1961.

Mixing in the Chemical Industry, Z. Sterbacek et al., Pergamom Press, pp. 14–17, 1965, Lib. of Congress, Cat. No. 64–24303.

Power Characteristics of Mixing Impellers, Part I, Ruston et al., Chemical Engineering Progress, pp. 395–404, vol. 46, No. 8, Aug. 1950.

Power Characteristics of Mixing Impellers, pp. 467–476, Chemical Engineering Progress, vol. 46, No. 9, Rushton et al.

*Primary Examiner*—Delbert E. Gantz
*Assistant Examiner*—William G. Wright
*Attorney, Agent, or Firm*—Deane E. Keith; Forrest D. Stine

[57] ABSTRACT

A process for preventing the formation of deleterious coke deposits on the walls of coal liquefaction reactor vessels involves passing hydrogen and a feed slurry comprising feed coal and recycle liquid solvent to a coal liquefaction reaction zone while imparting a critical mixing energy of at least 3500 ergs per cubic centimeter of reaction zone volume per second to the reacting slurry.

10 Claims, 1 Drawing Figure

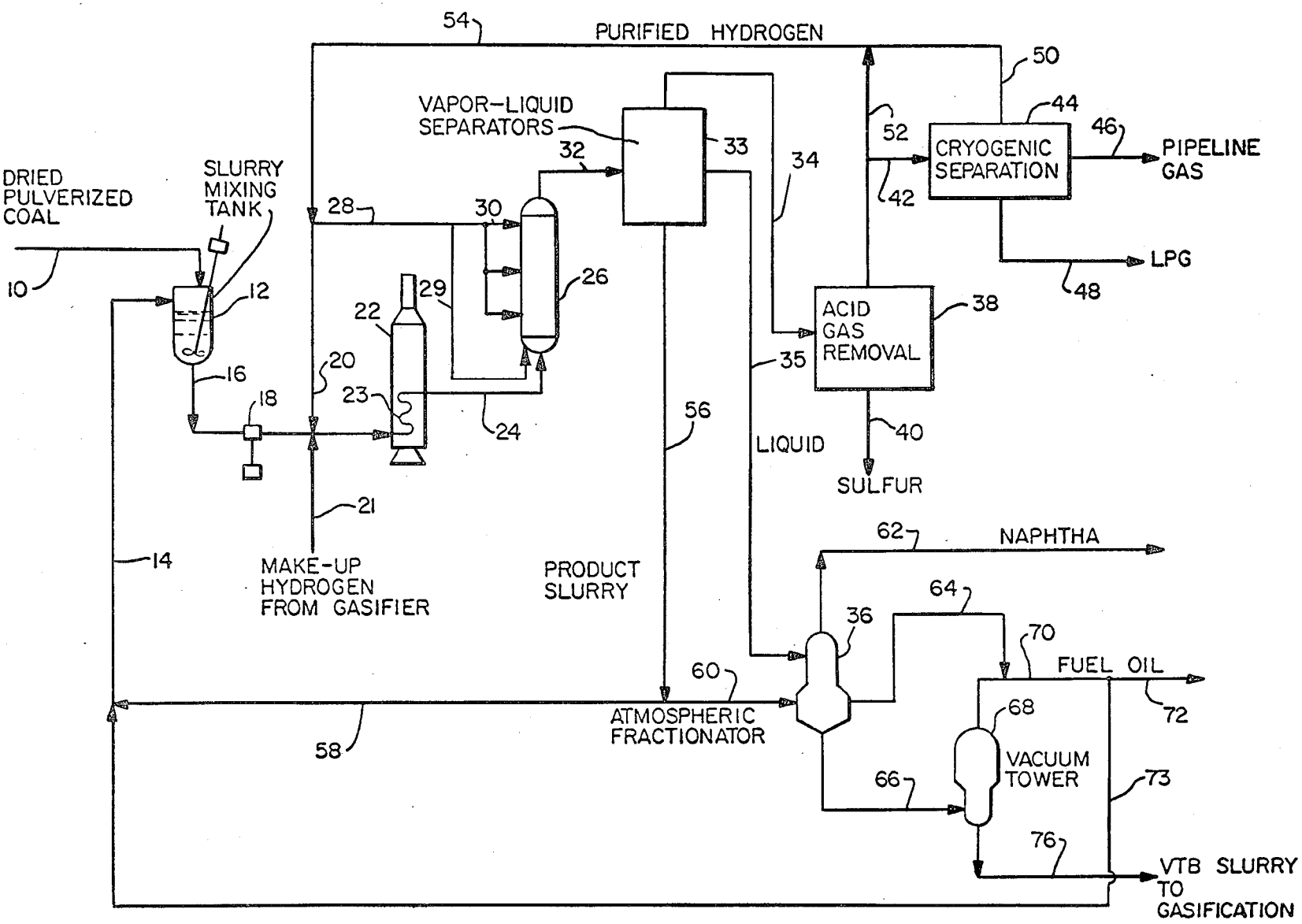
PIPELINE GAS
LPG
CRYOGENIC SEPARATION
ACID GAS REMOVAL
SULFUR
NAPHTHA
FUEL OIL
VACUUM TOWER
VTB SLURRY TO GASIFICATION
PURIFIED HYDROGEN
LIQUID
VAPOR-LIQUID SEPARATORS
ATMOSPHERIC FRACTIONATOR
PRODUCT SLURRY
MAKE-UP HYDROGEN FROM GASIFIER
SLURRY MIXING TANK
DRIED PULVERIZED COAL
10
12
14
16
18
20
21
22
23
24
26
28
29
30
32
33
34
35
36
38
40
42
44
46
48
50
52
54
56
58
60
62
64
66
68
70
72
73
76

PREVENTION OF DELETERIOUS DEPOSITS IN A COAL LIQUEFACTION SYSTEM

The Government of the United States of America has rights in this invention pursuant to Contract No. DE-AC01-79ET10104 awarded by the U.S. Department of Energy to the Pittsburg & Midway Coal Mining Co., a subsidiary of Gulf Oil Corporation.

FIELD OF THE INVENTION

This invention relates to a process for preventing formation of deleterious deposits on the walls of a coal liquefaction reactor. More particularly, this invention relates to a coal liquefaction process in which cementitious coke deposits are prevented by utilization of a minimum critical mixing energy in the coal liquefaction reactor.

BACKGROUND OF THE INVENTION

Coal liquefaction processes have been developed for converting coal to a liquid fuel product. For example, U.S. Pat. No. 3,884,794 to Bull et al. discloses a solvent refined coal process for producing reduced or low ash hydrocarbonaceous solid fuel and hydrocarbonaceous distillate liquid fuel from ash-containing raw feed coal in which a slurry of feed coal and recycle solvent is passed through a preheater and reactor in sequence in the presence of hydrogen, solvent and recycled coal minerals to increase the liquid product yield.

Reactor failure by coke deposition is a common problem in coal liquefaction systems. This problem can be so severe that liquefaction processing must be stopped for reactor cleaning, thereby causing a shutdown of the system and the usual problems attendant thereto. Techniques for continuous solds withdrawal from the reactor can not remove deleterious deposits which adhere strongly to the walls of the reactor vessel. Thus, it would be highly advantageous if solids deposition could be prevented, rather than merely eliminated after the solids are formed in the reactor, since physical removal means only remove solids which become dislodged from the internal reactor surfaces during normal operation.

SUMMARY OF THE INVENTION

A process has now been found for preventing the formation of deleterious deposits on the walls of the coal liquefaction reactor vessel, which process involves providing a minimum critical mixing energy to the coal liquefaction reaction zone so as to prevent hydrogen starvation in the slurry undergoing reaction and thereby prevent solids deposition on the reactor walls caused by insufficient hydrogen being supplied to the slurry. According to the present invention, a coal liquefaction process for reducing deleterious reaction zone deposits comprises passing hydrogen and a feed slurry comprising feed coal and recycle liquid solvent to a coal liquefaction reaction zone, imparting a minimum critical mixing energy of at least 3500 ergs per cubic centimeter of reaction zone volume per second to the slurry, thereby causing hydrogen transfer from the gaseous phase to the slurry in amounts sufficient to prevent hydrogen starvation of the slurry and substantially prevent formation of deleterious cementitious coke deposits. The present process not only prevents coke deposits, but increases the yield of total liquid produced ($C_5$-900° F.; $C_5$-482° C.), with a corresponding decrease in yield of $C_1$–$C_4$ hydrocarbon gases.

Although it is not intended to limit this invention to any particular theory or mechanism, it is believed that in a typical coal liquefaction reactor, hydrogen must enter the liquid phase before it can react with the thermally cleaved coal matrix. Although the mechanism of the reaction process is not well understood, it is believed that if the global reaction rate is to be unaffected by mass transport resistances, the mixing level within the reactor must be above some critical level. This critical mixing level is one where the intrinsic hydrogen mass transfer rate equals the point reaction rate in the liquid. If the hydrogen mass transfer rate falls below the intrinsic value, the resulting starvation of hydrogen within the liquid might induce retrogressive reactions resulting in a significant solid deposition as well as a significant reduction in liquid yield. It has thus been found that below a mixing energy level of approximately 3500 ergs per cubic centimeter of reaction zone volume per second for typical operating conditions, a significant hydrogen mass transfer limitation occurs. Below this limitation significant deposition of cementitious solid material occurs as well as a significant decrease in total liquid yield ($C_5$-900° F., $C_5$-482° C.). In addition, a reduction in mixing energy below such level changes the selectivity of the reaction as evidenced by a higher $C_1$–$C_4$ yield at the lower mixing energy levels. Moreover, below about 3500 ergs per cubic centimeter of reaction zone volume per second mixing energy, secondary coking reactions become predominant and the resultant coke forms deleterious deposits on the reactor vessel, plugs process piping, reactor inlets and outlets, and reduces the effective internal volume of the reactor, which also reduces the slurry residence time in the reaction zone, thus inhibiting completion of the reaction and reducing product yield. Solids deposition can occur to such a degree that the inlet and outlet ports of the reactor are totally occluded by solids preventing any use of the reactor and resulting in costly and time consuming clean up of the reactor.

As previously indicated, the coal liquefaction reaction is conducted under conditions wherein a minimum critical mixing energy of at least about 3500 ergs per cubic centimeter of reaction zone volume per second, preferably from about 3500 to about 4500 ergs per cubic centimeter of reaction zone volume per second, especially from about 3500 to about 4000 ergs per cubic centimeter of reaction zone volume per second is imparted to the slurry undergoing reaction. The critical mixing energy imparted to the reaction zone can be supplied in any suitable manner, including the use of an impeller in the reactor, the use of a gas sparge, or the like. Preferably, the desired mixing energy is provided by employing a gas sparge of hydrogen under pressure, wherein the hydrogen gas is fed to the reactor through one or more nozzles at a superficial gas velocity of from about three to about 20 centimeters per second, preferably from about 5 to about 10 centimeters per second.

Any suitable coal liquefaction reactor can be used, such as a non-packed reactor. Preferably, the reactor is a bubble column, namely, a reactor vessel having no significant flow obstructing internals, such as sieve trays, packing or the like. This minimizes possible sites for coke deposits to form. The reactor can also be one containing a mobile catalyst, such as an ebullated bed reactor. A continuous-stirred tank reactor (CSTR) can be used with the mixing energy being supplied by the impeller rather than or in addition to a gas sparge. The mixing energy imparted to the slurry undergoing reaction may be related to the RPM (revolutions per minute) of the impeller and the gas flow by the following equation:

$$P = 0.1063\left[\frac{Po^2ND^3}{Q^{0.56}}\right]^{0.45} + Q(1-\epsilon_g)\rho_s gh \quad \text{(I)}$$

where Po is the stirrer power input in the absence of gas introduction defined as:

$$Po = KN^3D^5\rho_s \quad \text{(II)}$$

The symbols in equations (1) and (2) are:

D=impeller diameter, cm
g=gravitational constant, cm/sec$^2$
h=reactor height, cm
K=empirical reactor design parameter
N=stirrer speed, sec$^{-1}$
Q=volumetric gas flow rate, cm$^3$/sec
$\epsilon_g$=gas holdup
$\rho_s$=slurry density, g/cm$^3$

BRIEF DESCRIPTION OF THE DRAWING

The drawing is a schematic flow diagram of a process utilizing the present invetion.

DESCRIPTION OF THE PREFERRED EMBODIMENTS

As shown in the process set forth in FIG. 1 of the drawings, dried and pulverized raw coal is passed through line 10 to slurry mixing tank 12 wherein it is mixed with recycle slurry containing recycle normally solid dissolved coal, recycle mineral residue and recycle distillate solvent boiling, for example, in the range of between about 350° F. (177° C.) to about 900° F. (482° C.) flowing in line 14. The expression "normally solid dissolved coal" refers to 900° F.+ (482° C.+) dissolved coal which is normally solid at room temperature.

The resulting solvent-containing feed slurry mixture contains greater than about 8 weight percent, preferably from about 8 to about 14, and most preferably from about 10 to about 14 weight percent recycle ash based on the total weight of the feed slurry in line 16. The feed slurry contains from about 20 to about 35 weight percent coal, preferably between about 23 to about 30 weight percent coal and is pumped by means of reciprocating pump 18 and admixed with recycle hydrogen entering through line 20 and with make-up hydrogen entering through line 21 prior to passage through preheater tube 23, which is disposed in furnace 22. The preheater tube 23 preferably has a high length to diameter ratio of at least 100 or 1000 or more.

The slurry is heated in furnace 22 to a temperature sufficiently high to initiate the exothermic reactions of the process. The temperature of the reactants at the outlet of the preheater is, for example, from about 700° F. (371° C.) to 760° F. (404° C.). At this temperature the coal is essentially all dissolved in the solvent, but the exothermic hydrogenation and hydrocracking reactions are beginning. Whereas the temperature gradually increases along the length of the preheater tube, the back-mixed dissolver is at a generally uniform temperature throughout and the heat generated by the hydrocracking reactions in the reactor raises the temperature of the reactants, for example, to the range of from about 820° F. (438° C.) to about 870° F. (466° C.).

The slurry undergoing reaction is passed by means of line 24 into reactor 26. Likewise, recycle hydrogen in line 28 is passed by means of line 29 into the lower portion of reactor 26 along with the slurry to serve as a hydrogen sparge. Reactor 26 is a bubble column containing no packing.

The hydrogen sparge gas is introduced into reactor 26 at a superficial gas velocity of from about 3 to about 20 centimeters per second, preferably from about 5 to about 10 centimeters per second, and the hydrogen can have any suitable purity, for example, from about 60 to about 100 volume percent hydrogen, preferably from about 80 to about 95 volume percent hdrogen. Likewise, other gases, such as synthesis gas, which comprises carbon monoxide and hydrogen can be utilized as sparge gas. Reactor 26 can also be provided with an impeller if desired to provide additional mixing energy.

Regardless of the means utilized to provide the minimum critical mixing energy, the slurry undergoing reaction in reactor 26 should be provided with at least about 3500 ergs per cubic centimeter of reaction zone volume per second, preferably from about 3500 to about 4500 ergs per cubic centimeter of reaction zone volume per second. If desired, hydrogen quench can be introduced into reactor 26 by means of line 30 at various points to control the reactor temperature.

The temperature conditions in the reactor can include, for example, a temperature in the range of from about 430° to about 470° C. (806° F. to 878° F.), preferably from about 445° to about 465° C. (833° to 869° F.). Use of the highest level in this range is preferred.

The slurry undergoing reaction is subjected to a total slurry residence time in the "reaction zone" of from about 0.5 to about 2 hours, preferably from about 1.0 to about 1.7 hours, which includes the nominal residence time at reaction conditions within the preheater, reactor and downstream separators.

The hydrogen partial pressure is at least about 1500 psig (105 kg/cm$^2$) and up to 4000 psig (280 kg/cm$^2$), preferably between about 2000 to about 3000 psig (154 and 210 kg/cm$^2$). Hydrogen partial pressure is defined as the product of the total pressure and the mole fraction of hydrogen in the feed gas. The hydrogen feed rate ratio is between about 2.0 and about 6.0, preferably between about 4 and about 6.0 weight percent based upon the weight of the slurry fed. The hydrogen feed rate includes both the hydrogen introduced with the slurry feed and the hydrogen sparge gas, if any.

The dissolver effluent passes through line 32 to vapor-liquid separator system 33. Vapor-liquid separation system 33, consisting of a series of heat exchangers and vapor-liquid separators, separates the dissolver effluent into a non-condensed gas stream 34, a condensed light liquid distillate in line 35 and a product slurry in line 56. The condensed light liquid distillate from the separators passes through line 34 to atmospheric fractionator 36. The non-condensed gas in line 32 comprises unreacted hydrogen, methane and other light hydrocarbons, along with $H_2S$ and $CO_2$, and is passed to acid gas removal unit 38 for removal of $H_2S$ and $CO_2$. The hydrogen sulfide recovered is converted to elemental sulfur which is removed from the process through line 40. A portion of the purified gas is passed through line 42 for further processing in cryogenic unit 44 for removal of much of the methane and ethane as pipeline gas which passes through line 46 and for the removal of propane and butane as LPG which passes through line 48. The purified hydrogen in line 50 is blended with the remaining gas from the acid gas treating step in line 52 and comprises the recycle hdrogen for the process.

The liquid slurry from vapor-liquid separators 33 passes through line 56 and comprises liquid solvent, normally solid dissolved coal and catalytic mineral residue. Stream 56 is split into two major streams, 58 and 60, which have the same composition as line 56.

In fractionator 36 the slurry product from line 60 is distilled at atmospheric pressure to remove an overhead naphtha stream through line 62, a middle distillate stream through line 64 and a bottoms stream through line 66. The naphtha stream in line 62 represents the net yield of naphtha from the process. The bottoms stream in line 66 passes to vacuum distillation tower 68. The temperature of the feed to the fractionation system is normally maintained at a sufficiently high level that no additional preheating is needed other than for stratup operations.

A blend of the fuel oil from the atmospheric tower in line 64 and the middle distillate recovered from the vacuum tower through line 70 makes up the major fuel oil product of the process and is recovered through line 72. The stream in line 72 comprises 380°–900° F. (193°–482° C.) distillate liquid and a portion thereof can be recycled to the feed slurry mixing tank 12 through line 73 to regulate the solids concentration in the feed slurry. Recycle stream 73 imparts flexibility to the process by allowing variability in the ratio of solvent to total recycle slurry which is recycled, so that this ratio is not fixed for the process by the ratio prevailing in line 58. It also can improve the pumpability of the slurry. The portion of stream 72 that is not recycled through line 73 represents the net yield of distillate liquid from the process.

The bottoms from vacuum tower 68, consisting of all the normally solid dissolved coal, undissolved organic matter and mineral matter of the process, but essentially without any distillate liquid or hydrocarbon gases is discharged by means of line 76, and may be processed as desired. For example, such stream may be passed to a partial oxidation gasifier (not shown) to produce hydrogen for the process in the manner described in U.S. Pat. No. 4,159,236 to Schmid, the disclosure of which is hereby incorporated by reference. A portion of the VTB could be recycled directly to mixing tank 12, if this were desirable.

EXAMPLE

Tests were conducted to demonstrate the effect of mixing energy on the deposition of coke in a coal liquefaction reactor. Pittsburgh seam coal was used in the tests and had the following analysis:

| Pittsburgh Seam Coal (Percent by Weight-Dry Basis) | |
|---|---|
| Carbon | 66.84 |
| Hydrogen | 4.78 |
| Sulfur | 5.00 |
| Nitrogen | 1.17 |
| Oxygen | 5.97 |
| Ash | 16.24 |

A feed slurry is prepared for each test by mixing pulverized coal with liquid solvent and recycle slurry containing liquid solvent, normally solid dissolved coal and catalytic mineral residue. The liquid solvent was derived from a coal liquefaction process and had a normal boiling range of 380°–900° F. (193°–482° C.). The tests took place in a one-liter CSTR reactor with only the stirrer RPM being varied. The mixing energy imparted to the slurry inside the reaction zone by the stirrer and gas flow is described by equation (I), above, wherein:

$D = 1\frac{7}{8}$ in. or 4.76 cm. (two turbines on shaft)
$g = 980.6$ cm/sec$^2$
$h = 9$ in. or 22.9 cm.
$K = 6.3$
$N = 6.67$ sec$^{-1}$
$\epsilon_g = 0$
$\rho_s = 1.2$ g/cm$^3$
$Q = 2.91$ cm$^2$/sec Thus, $$Po = KN^3D^5\rho_s = 10.98 \times 10^6 \text{ ergs/sec (two turbines)}$$

$$0.1063\left[\frac{Po^2ND^3}{Q^{0.56}}\right]^{0.45} = 3.40 \times 10^6 \text{ ergs/s}$$

$$Q(1-\epsilon_g)\rho_s gh = 0.078 \times 10^6 \text{ ergs/sec}$$

Thus, P/V (the mixing energy per unit of reaction zone volume)≅3500 ergs/cm$^3$/sec. This specific mixing energy corresponds to an RPM value of 400 RPM for the system studied.

Processing conditions which were held at constant levels throughout the series of tests included: a reactor temperature of 455° C.; an inlet hydrogen partial pressure of 2000 psig; a nominal slurry residence time in the reactor of one hour; the feed coal concentration in the feed slurry of 30 weight percent; and a recycle ash concentration in the feed slurry of 8.7 weight percent. All other feed slurry compositional variables were held constant throughout the test series. Only the stirrer RPM was varied. Each test lasted for 16 hours.

The test results were as follows:

| Test | RPM | $H_2$ Feed Rate (ft.$^3$/hr.) | Solid Reactor Deposits (% reactor volume occupied) |
|---|---|---|---|
| 1 | 1000 | 20 | 0 |
| 2 | 400 | 20 | 0 |
| 3 | 200 | 20 | 3.7 |
| 4 | 150 | 20 | 10.3 |

The test results clearly show the minimum critical mixing energy to be about 3500 ergs/cm$^3$/sec, which corresponds to 400 RPM.

What is claimed is:

1. A coal liquefaction process for reducing deleterious reaction zone deposits, which process comprises passing hydrogen and a feed slurry comprising feed coal and recycle liquid solvent to a non-packed coal liquefaction reaction zone, said feed slurry is reacted in said coal liquefaction zone under a temperature in the range of between about 430° to about 470° C., a hydrogen partial pressure of at least about 1500 psig, for a total slurry residence time of from about 0.5 to about 2 hours, and imparting a critical mixing energy of at least about 3500 ergs per cubic centimeter of reaction zone volume per second to said feed slurry in said reaction zone, thereby causing hydrogen transfer from the gaseous phase to the slurry in amounts adequate to prevent hydrogen starvation of said slurry and substantially prevent formation of deleterious cementitious coke deposits.

2. The process of claim 1 wherein the mixing energy is in the range of between about 3500 and about 4500 ergs per cubic centimeter of reaction zone volume per second.

3. The process of claim 1 wherein said minimum critical mixing energy is supplied by using a gas sparge to said reaction zone.

4. The process of claim 3 wherein said gas sparge comprises hydrogen.

5. The process of claim 3 wherein said gas sparge comprises synthesis gas.

6. The process of claim 1 wherein said reaction zone is provided with an impeller to supply said critical mixing energy.

7. The process of claim 4 wherein said hydrogen sparge comprises feeding a gas comprising hydrogen to said reaction zone at a superficial rate of from about 3 to about 20 centimeters per second.

8. The process of claim 7 wherein said hydrogen sparge is fed to said reaction zone at a superficial rate of from about 5 to about 10 centimeters per second.

9. The process of claim 1 whereifn said critical mixing energy is supplied solely by the use of an impeller in said reaction zone.

10. The process of claim 1 wherein said feed slurry additionally comprises recycle mineral residue and recycle normally solid dissolved coal.

* * * * *